United States Patent [19]

Chen

[11] Patent Number: 4,953,348

[45] Date of Patent: Sep. 4, 1990

[54] SYNCHRONOUS YARN FEEDING DEVICE

[76] Inventor: Jen F. Chen, P.O. Box 1-79, Taipei, Taiwan, 10602

[21] Appl. No.: 425,392

[22] Filed: Oct. 23, 1989

Related U.S. Application Data

[63] Continuation of Ser. No. 216,959, Jul. 11, 1988, abandoned.

[51] Int. Cl.[5] ..... D01H 13/14

[52] U.S. Cl. ..... 57/85; 57/90; 66/132 T

[58] Field of Search ..... 57/90, 91, 104, 352, 57/85; 226/155, 171, 170, 193; 242/47.01; 474/101, 102, 140, 184, 190, 191, 250; 66/132 T, 132 R

[56] References Cited

U.S. PATENT DOCUMENTS

| | | | |
|---|---|---|---|
| 2,707,403 | 5/1955 | Thomson et al. | 474/191 X |
| 3,050,178 | 8/1962 | Stone | 198/834 |
| 3,363,815 | 1/1968 | Vostal | 66/132 X |
| 3,561,045 | 2/1971 | Heffernan | 57/91 X |
| 3,862,711 | 1/1975 | Smith et al. | 66/132 T X |
| 3,922,887 | 12/1975 | Mishcon | 226/171 X |
| 4,004,438 | 1/1977 | Raisin | 242/47.01 X |
| 4,072,062 | 2/1978 | Morling et al. | 198/834 |
| 4,136,837 | 1/1979 | Fecker et al. | 242/47.01 |
| 4,355,747 | 10/1982 | Vinas | 66/132 T X |
| 4,457,144 | 7/1984 | Sawazaki | 66/132 T |

OTHER PUBLICATIONS

David J. Spencer, Knitting Technology, (pp. 31, 38, 39, 42, 43), 1983.

Dr. J. J. F. Knapton, Yarn Friction in Knitting, (pp. 205–207, 212, 213), 1983.

*Primary Examiner*—Joseph J. Hail, III

*Attorney, Agent, or Firm*—Lalos & Keegan

[57] ABSTRACT

A synchronous yarn feeding device comprises a yarn feeding drum and a driving belt. The drum is provided with protrusions or studs that are arranged for cooperative engagement with concave surfaces or holes in the driving belt. A portion of the driving belt presses yarn onto the drum such that rotation of the drum and feeding of the yarn are synchronous with the speed of the driving belt.

15 Claims, 4 Drawing Sheets

SYNCHRONOUS YARN FEEDING DEVICE

This is a continuation of co-pending application Ser. No. 216,959, filed on July 11, 1988, now abandoned.

BACKGROUND OF THE INVENTION

The present invention relates to a synchronous yarn feeding device for a textile machine.

As is known in the art, yarn is delivered by means of a yarn feeding drum and a driving belt. FIG. 11 illustrates a typical conventional yarn feeding device. The drum 1 having a plurality of round bars 3 formed with a cage-shaped periphery is rotatably mounted on a yarn guide frame 5. A belt 2 presses the yarn 9 onto the smooth outer periphery of the drum, thereby continuing the yarn feeding operation by frictional force. On frame 5 a pair of porcelain eyes 8 are mounted for guiding the incoming yarn and the outgoing yarn, respectively. Eyes 8 guide the incoming yarn F or outgoing yarn under pressure of belt 2 so that the yarn can be fed on or off the drum.

A drawback of prior art yarn feeding apparatus is that instability and inaccuracies may be introduced into the yarn feeding operation. As the amount of yarn fed on the drum is increased, the contact surface between the belt and the drum is decreased and the contact surface becomes irregular. Therefore, the driving belt 2 will have a different effect on the speed of the turning drum for each drum that it is in contact with. Moreover, these differences are not easily perceived by the operator, and thus cannot be corrected by adjusting any conventional means. The quality of weaved cloth is therefore degraded. Yarn breakage is increased and the profitability of production is decreased.

SUMMARY OF THE INVENTION

Therefore, an object of the present invention is to provide a synchronous yarn feeding device, which enables the rotation speed of each yarn feeding drum, the yarn feeding speed and the driving speed of belt to be synchronized, thereby making uniform the feeding speed and tension of each of the yarn strands pressed on each of respective yarn feeding drums by the same belt.

A further object of the present invention is to provide a synchronous yarn feeding drum with an elastic body whereby the elasticity of said elastic body yields a relatively larger contacting surface for the yarn and a less slippery surface so that the yarn feeding operation will be more stable and accurate.

Other objects and advantages of the present invention will become evident from the following description.

DETAILED DESCRIPTION OF THE PREFERRED EMBODIMENTS

Figure 1:
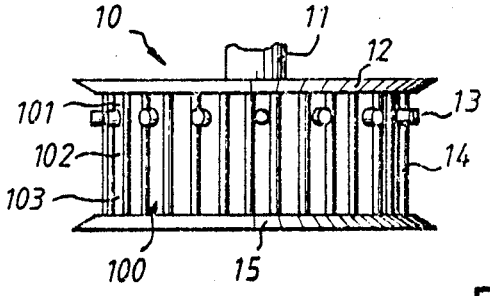
FIG. 1 is a front view of the first embodiment according to the present invention.

For the purpose of easy cross reference between the description of each of the preferred embodiments of the invention, the same reference labels are used to designate similar components of the various embodiments of the present invention.

The basic components of the synchronous yarn feeding device of the present invention comprise a yarn feeding drum, a driving belt, a yarn guiding frame, an incoming yarn guide eye and an outgoing yarn guide eye. For the purpose of simplicity, the yarn guiding frame and outgoing yarn guide eye are omitted in the drawings and description.

While the preferred embodiments of the present invention include projections or protrusions on the drum and corresponding holes or slots on the belt, alternate positioning/driving means can be provided on the drum or belt. For example, studs could be provided on the belt and holes provided in the drum. The important concept is that a first portion on the outer periphery of the drum is synchronously driven by the endless driving belt with the aid of a positioning/driving means on both the drum and belt. In this manner, the yarn feeding drum of the present invention functions as a conventional driving pulley to drive the drum in addition to performing the function of feeding yarn. The drum of the present invention is directly and synchronously driven by the endless driving belt so that the yarn wound on the drum and further pressed thereon by the driving belt will be fed in synchronism with the driving speed of the driving belt with the aid of the driving/positioning means on the drum and belt.

Figure 2:
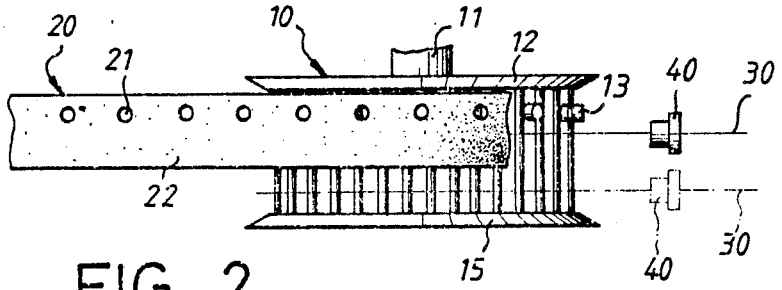
FIG. 2 is an illustrative diagram showing the use of the device of FIG. 1.

Referring to FIGS. 1 and 2, a first embodiment of the present invention is illustrated. A yarn feeding drum 10 is rotatably mounted on a frame (not shown), and includes a plurality of round bars 14, an upper cover 12, a lower cover 15 and a linking shaft 11. Drum 10 is provided with a solid cylinder 100 arranged within the round bars 14. A plurality of positioning/driving means in the form of protrusions or studs 13 is located on a first portion of the outer periphery of cylinder 100 near the upper cover 12. Each of the protrusion 13 is interposed between every two round bars 14 on a first portion 101 of cylinder 100 located at the upper part of the yarn feeding drum 10. The drum 10 is driven by belt 20 that includes a first portion of the upper part of belt 20 with a corresponding positioning/driving means in the form of holes 21. Each of the protrusions or studs 13 is sequentially engaged by holes 21. Yarn feeding drum 10 is thereby driven synchronously with driving belt 20.

As shown in FIG. 2, in the yarn feeding operation, yarn 30 is guided through a guiding eye 40 to a second portion 102 of the yarn feeding drum 10 and is pressed onto drum portion 102 by a second portion 22 of the driving belt 20. Yarn feeding drum 10 is driven synchronously with belt 20 as previously described. Yarn 30, pressed between second portions 22 and 102, is thereby driven forward synchronously with the belt 20, thus achieving the goal of precise yarn feeding. When the yarn is not being fed or is being unwound, the yarn guiding eye 40 is displaced downward, as shown in the dashed lines 40 of FIG. 2. Yarn 30 will not be pressed by the second portion 22 of driving belt 20 in this position, and the yarn will slide along a third portion 103 of the yarn feeding drum 10, as shown in dashed line 30 in FIG. 2.

Figure 3:
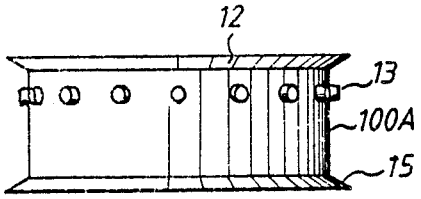
FIG. 3 is a front view of the second embodiment according to the present invention.

An alternative embodiment of the yarn feeding drum 10 is illustrated in FIG. 3. As shown, the outer periphery of the drum, rather than including a plurality of round bars, is made solid, as indicated at 100A. A plurality of studs 13 is arranged along a first portion thereof.

Figure 4:
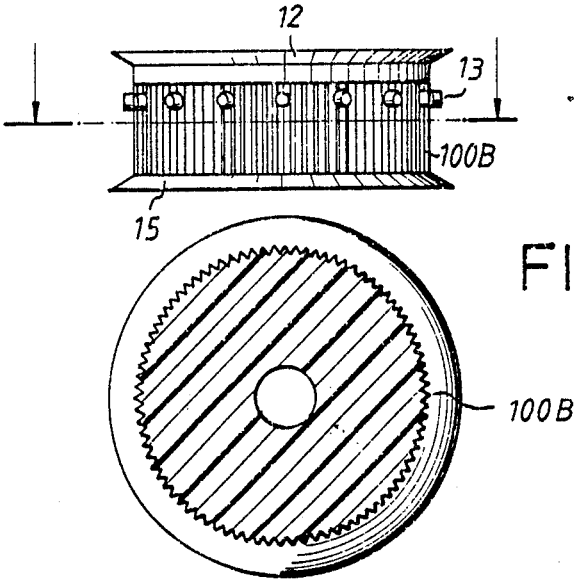
FIG. 4 shows a front view and a cut-away view of the third embodiment according to the present invention.

FIG. 4 illustrates a third embodiment of the present invention, wherein the outer periphery of the yarn feeding drum 10 has a sawtooth configuration indicated at 100B. A plurality of protrusions or studs 13 is disposed on the periphery of the drum 10 and achieve the same goal as the protrusions or studs described above.

Figure 5:
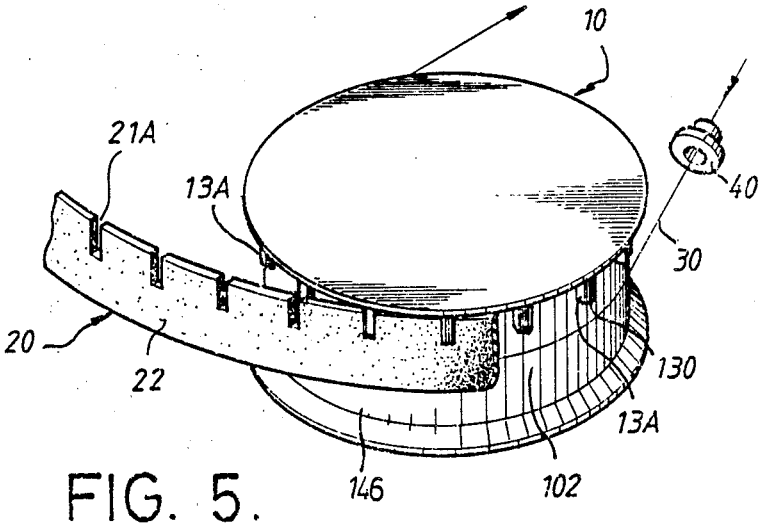
FIG. 5 is a perspective view of the fourth embodiment according to the present invention.

A fourth embodiment of the present invention is illustrated in FIG. 5. A plurality of projections 13A is formed on a first portion of the drum 10. A first portion of a belt 20 is formed with a plurality of respective cutout slots 21A, whereby the slots 21A engage the projections 13A of the drum with the yarn 30 being pressed between a second portion 22 of the belt 20 and a second portion 102 of the drum to enable precise feeding of yarn.

Figure 6:
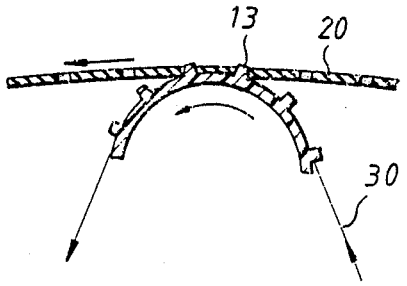
FIG. 6 is a representative cross-sectional view of the embodiments of the present invention.

FIG. 6 illustrates the cooperation between the positioning/driving means on both the drum and the belt. A first portion 101 of the drum is provided with a plurality of equally spaced protrusions 13. The protrusions are sequentially engaged by respective holes or slots in driving belt 20, thus enabling the drum 10 to rotate synchronously with belt 20. Yarn 30 is pressed upon the outer periphery of the drum 10 by driving belt 20 and thus fed synchronously with the drum 10 and belt 20 to provide a precisely fed supply of yarn.

Figure 7:
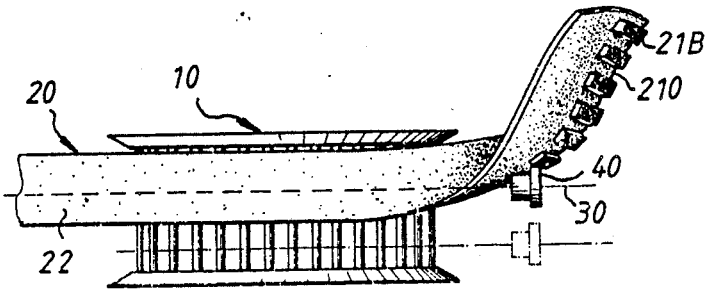
FIG. 7 is a front view of the fifth embodiment according to the present invention.

A fifth embodiment of the present invention is shown in FIG. 7. A driving belt 20 is provided with a plurality of projections 21B. The plurality of projections 21B is equally spaced by distance 210. The driving belt 20 is thereby configured to cooperate with a cage-shaped drum 10 whereby each of the projections 21B fits into a corresponding space between each two of the round bars in the drum 10. Thus, rotation of drum 10 and delivery of the yarn are synchronous with movement of driving belt 20.

Figure 8:
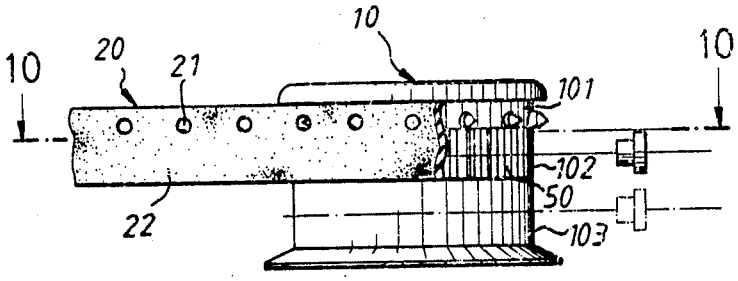
FIG. 8 is a front view of the sixth embodiment according to the present invention.
Figure 9:
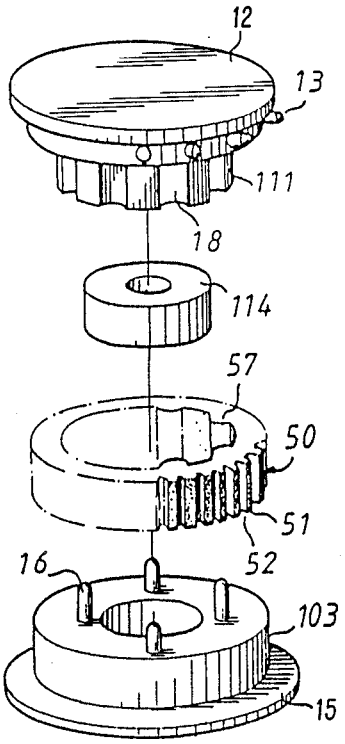
FIG. 9 is an exploded view of the embodiment in FIG. 8.
Figure 10:
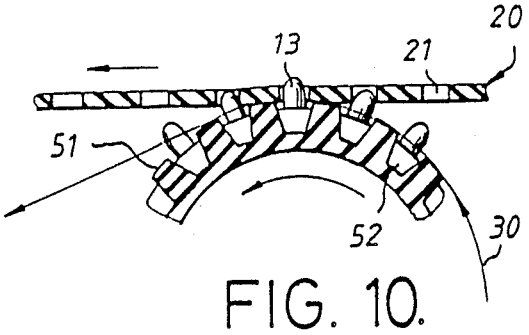
FIG. 10 is a cut-away view taken along line 10—10 of FIG. 8.
Figure 11:
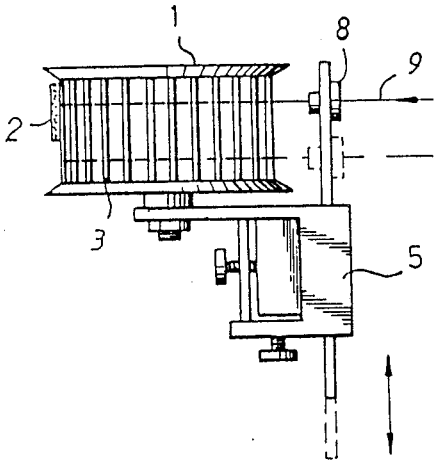
FIG. 11. (PRIOR ART)
FIG. 11 shows a front view of a yarn feeding device of the prior art.

FIGS. 8 to 10 illustrate a sixth embodiment of the present invention. In order to provide a relatively larger and slip resistant contact surface on drum 10 for the yarn, a resilient body 50 is disposed to cover the second portion 102 of the drum. In the embodiment shown in FIGS. 8 to 10, the second portion 102 of the outer periphery of the drum 10 is provided with a resilient body 50 such that the resilient body, while being contacted by driving belt 20, will become flatter and thinner, thus providing a relatively large contact surface with driving belt 20. Thus, the contact surface between yarn 30 and the outer periphery of the drum 10 will be larger and more slip resistant. The resilient body 50 can be formed with a plurality of protruding portions 51 interposed with a plurality of concave portions 52, as shown in FIGS. 9 and 10.

The resilient body 50 is shown with the drum 10 of the second embodiment shown in FIG. 3. Other embodiments of drum 10 may also be arranged with the same resilient body 50, if desired.

FIG. 10 illustrates the yarn feeding arrangement in which the apparatus of the embodiment of FIGS. 8 and 9 are employed. Slipping or movement of the yarn 30 is inhibited by the contact of yarn 30 with the protruding portions 51 of body 50. Contact with portions 51 increases the stability and precision of the yarn feeding operation that is synchronous with the rotation of drum 10.

FIG. 9 illustrates a detailed construction of the sixth embodiment of the present invention. A plurality of protrusions 13 is provided on upper disk 12 below which are disposed a plurality of grooves 18 on body 111. A bearing 114 is inserted into a central opening (not shown) in upper cover 12. A resilient body 50 fits around the outer periphery of body 111. A plurality of protruding walls 57 located within the inner surface of resilient body 50 fits into grooves 18 of body 111. A plurality of protruding poles 16 on a lower disk 15 fits into respective holes (not shown) on the upper disk 12, thereby fixing the upper and lower disks together. The upper surface of a third portion 103 of disk 12 engages resilient body 50. Resilient body 50 is thereby bound between the upper and lower disks 12 and 15. An easily manufactured and firmly constructed synchronous yarn feeding drum is thereby provided.

In summary, the present invention provides a synchronous Yarn feeding device with a drum comprising a positioning/driving means including, for example, a plurality of equally-spaced protrusions, and a belt comprising a positioning/driving means including, for example, a plurality of respective holes. The yarn is pressed upon a second portion of the drum and is fed in synchronization with the rotation of the yarn feeding drum and the driving belt. The productivity of textile machines and the quality of product are both greatly enhanced.

It is to be understood that the embodiments shown in the drawings and described herein are examples of the teachings of the present invention. Other variations may be made by those skilled in the art without departing from the spirit and scope of the present invention.

I claim:

1. A yarn feeding device for use in a textile machine, said textile machine including a machine body and a frame fixed on said body, said yarn feeding device comprising:

a drum rotatably mounted on said frame;

a yarn guiding means movably mounted beside said drum on said frame;

an endless driving belt provided to engage said drum at the outer circumference thereof;

a yarn being fed by said belt on said drum; wherein said drum includes an outer periphery with a first portion having a first rigid projecting engaging means for engaging a corresponding portion of said driving belt, a second drum portion adjacent said first drum portion for receiving a portion of yarn being fed onto said drum when said drum is engaged with a corresponding portion of said driving belt, and a third drum portion for receiving a portion of yarn being fed off said drum when said yarn guiding means is operatively moved toward said third portion of said drum;

said driving belt includes a first belt portion having a second engaging means for cooperative engagement with said first drum portion and said first engaging means, and a second belt portion having a substantial major portion adjacent said first belt portion for pressing a portion of yarn against said drum second portion as a portion of yarn is fed onto said drum; and wherein said first engaging means provided on said drum and said second engaging means provided on said driving belt are cooperatively interlocked with each other to maintain the position of said belt second portion relative to said drum second portion in an axial direction with respect to said drum so as to effectively prevent said belt from an axial movement; and said yarn guiding means is operatively controlled to guide movement of said yarn only in the region between said second drum portion and said third drum portion;

whereby when said yarn guiding means is operatively moved to guide said yarn toward said second portion of said belt and said drum, said yarn will be pressed between and driven by the inner surface of said second belt portion and the outer surface of said second drum portion in synchronism with said driving belt and the rotation of said drum so that a substantially constant and uniform yarn feeding operation is provided; and when said yarn guiding means is operatively moved to guide said yarn from said second portion to said third portion of said drum, said yarn is not driven by said driving belt.

2. A yarn feeding device according to claim 1, wherein said first engaging means comprises a plurality of protruding surfaces and said second engaging means comprises a plurality of engaging concave surfaces for complementary engagement with said protruding surfaces of said first engaging means.

3. A yarn feeding device according to claim 1, wherein said first engaging means comprises a plurality of studs and said second engaging means comprises a plurality of holes for interlocking engagement with said studs.

4. A yarn feeding device according to claim 3 wherein a front portion of each of said studs is tapered.

5. A yarn feeding device according to claim 3 wherein said holes are provided on one side of said driving belt.

6. A yarn feeding device according to claim 5, wherein said studs are provided at one side of said drum outer periphery.

7. A yarn feeding device according to claim 1, wherein said second portion of said drum outer periphery comprises a plurality of protrusions interposed with a plurality of grooves aligned with said driving belt to receive a portion of yarn and to feed said yarn from said belt.

8. A yarn feeding device according to claim 1, wherein said second portion of said drum outer periphery comprises a substantially round outer surface.

9. A yarn feeding device according to claim 1 wherein said second portion of said drum outer periphery comprises a rough surface whereby slippage of said yarn on said surface is inhibited.

10. A yarn feeding device according to claim 1 wherein said second portion of said drum outer periphery comprises an elastic body.

11. A yarn feeding device according to claim 1, wherein said second portion of said drum outer periphery comprises a body having a plurality of convex and concave portions.

12. A yarn feeding device according to claim 1 wherein said outer periphery of said drum comprises a plurality of round bars and said first engaging means comprises a plurality of protrusions interposed between said round bars and projecting out of said drum outer periphery.

13. A yarn feeding device according to claim 1, wherein said first engaging means and said second engaging means are cooperatively interlocked with each other at a predetermined position in an axial direction with respect to the drum.

14. A yarn feeding device according to claim 13, wherein said interlocked position of said first and second engaging means is provided on the upper or lower side of said driving belt and drum.

15. A yarn feeding device according to claim 13, wherein said second drum portion and said second belt portion provide said feeding yarn with a substantially even surface to surface contact between the inner surface of the belt and the outer surface of the yarn to provide uniform yarn tension at each discrete point of outgoing yarn fed from said belt and drum during a yarn feeding operation.

* * * * *